US006623072B1

(12) United States Patent
Mellace

(10) Patent No.: US 6,623,072 B1
(45) Date of Patent: Sep. 23, 2003

(54) BEACH CHAIR WITH INTEGRAL AUDIO PLAYER

(76) Inventor: Leo Mellace, 60 Thorndike St., Revere, MA (US) 02151

( * ) Notice: Subject to any disclaimer, the term of this patent is extended or adjusted under 35 U.S.C. 154(b) by 0 days.

(21) Appl. No.: 10/373,314

(22) Filed: Feb. 24, 2003

Related U.S. Application Data

(62) Division of application No. 09/954,873, filed on Sep. 18, 2001, now Pat. No. 6,523,894.

(51) Int. Cl.[7] ..... A47C 31/00

(52) U.S. Cl. ..... 297/214.4; 297/188.19; 297/188.04; 297/183.5; 297/16.1

(58) Field of Search ..... 297/217.4, 188.19, 297/188.04, 183.5, 16.1, 217.5, 217.3, 217.1, 188.14, 35, 31

(56) References Cited

U.S. PATENT DOCUMENTS

| | | | |
|---|---|---|---|
| 1,700,337 | A | 1/1929 | Renner |
| 2,879,835 | A | 2/1959 | Miller |
| 4,064,376 | A | 12/1977 | Yamada |
| 4,072,346 | A | 2/1978 | Schueler |
| 4,841,587 | A | 6/1989 | Carter et al. |
| 4,868,888 | A | 9/1989 | Dayton |
| 4,979,777 | A | 12/1990 | Takada |
| 5,318,340 | A | 6/1994 | Henry |
| 5,326,152 | A | 7/1994 | Baron |
| 5,482,352 | A | 1/1996 | Leal et al. |
| 5,611,594 | A | 3/1997 | Findlay |
| 5,620,229 | A | 4/1997 | Ledford |
| 5,624,156 | A | 4/1997 | Leal et al. |
| 5,628,544 | A | 5/1997 | Goodman et al. |
| 5,683,137 | A | 11/1997 | MacDonald et al. |
| 5,913,572 | A | 6/1999 | Grimaldi et al. |
| 6,102,476 | A | 8/2000 | May et al. |
| 6,149,238 | A | 11/2000 | Tsai |

*Primary Examiner*—Milton Nelson, Jr.
(74) *Attorney, Agent, or Firm*—Morse, Altman & Martin

(57) ABSTRACT

A foldable beach chair with an audio player integrated into the armrest. A compact disk player is hinged at the bottom to open outwardly from the stationary section on the armrest. When closed, the CD player forms a seal that substantially protects the CD from the beach environment. A mechanical clasp holds the CD player closed when the CD is playing. The other armrest has a covered storage compartment and, optionally, a drink holder. Optionally, the chair has a large pouch composed of a mesh material. Optionally, the chair has as set of small pouches. Optionally, the chair has a carrying strap.

6 Claims, 3 Drawing Sheets

BEACH CHAIR WITH INTEGRAL AUDIO PLAYER

CROSS-REFERENCES TO RELATED APPLICATIONS

The present application is a divisional application of application Ser. No. 09/954,873, dated Sep. 18, 2001, now U.S. Pat. No. 6,523,894, for BEACH CHAIR WITH INTEGRAL AUDIO PLAYER in the name of Leo Mellace.

STATEMENT REGARDING FEDERALLY SPONSORED RESEARCH OR DEVELOPMENT

Not Applicable

REFERENCE TO A SEQUENCE LISTING, A TABLE, OR A COMPUTER PROGRAM LISTING COMPACT DISK APPENDIX

Not Applicable

BACKGROUND OF THE INVENTION

1. Field of the Invention

The present invention relates to chairs, more particularly, to beach chairs with facilities for providing audio entertainment.

2. Description of the Related Art

If a person wishes to listen to music while sitting in a beach chair at the beach, in the back yard sunning, or in other similar situations, there are several options. The first is to use a large portable player, what is commonly referred to as a "boom box." One problem is that it is not private; everyone else in earshot also hears it. Another problem is that it is bulky and must be carried separately. A third problem is that the environment, in the form of beach sand, can have detrimental effects on the player.

A second option is to use a handheld portable player with headphones. The problem of other people hearing it is resolved, and it is typically small enough to fit in a backpack or bag. However, it can still suffer detrimental effects from the environment.

BRIEF SUMMARY OF THE INVENTION

An object of the present invention is to provide a combination foldable chair and audio player to provide several advantages over the prior art, including privacy and protection from the environment for the player media.

The present invention is a beach chair with an integral audio player permanently mounted within the armrest. Any form of foldable beach chair known in the art is contemplated for use. The chair has a rigid frame that can be folded to a more compact size for carrying. The chair is light in weight to facilitate carrying.

The audio player is permanently mounted in an armrest. Any of a number of different kinds of audio players are contemplated for use by the present invention, including compact disk players, tape cassette players, MP3 players, minidisc players, and radio. It is also contemplated that more than one type of audio player may be integrated into a single chair of the present invention.

In one configuration, the audio player is a compact disk (CD) player. The CD player is vertical and is hinged at the bottom. The hinged section opens outwardly from the stationary section. Optionally, sliding arms prevent the hinged section from opening too far. When closed, the CD player forms a seal that substantially protects the CD from the environment, for example, sand and salt water. The seal may be formed in any manner known in the art, for example, by a rubber o-ring.

The CD player drive mechanism is in either the hinged section or stationary section. The electronics, including the battery, can be located wherever is practical, in the hinged section, stationary section, and/or other parts of the chair. The headset jack may be located wherever it is convenient.

A mechanical clasp holds the CD player closed when the CD is playing. In one configuration, the CD controls are located on the clasp so that the controls are visible and convenient. Alternatively, the CD controls are located in the upper end of the CD player. Alternatively, the controls are located on the armrest.

In another configuration, the audio player is a cassette tape player. The cassette player may be hinged at the bottom, like the CD player, or it may have an external slot into which the cassette tape is inserted. In the latter configuration, the slot should have a door to prevent damage to the internal mechanism by the environment.

Other configurations include an integral minidisc player, MP3 player, radio, and combinations of the above.

The other armrest has a storage compartment. Preferably, the compartment is large enough to hold at least several copies of the player media. The compartment 60 may have a cover so that the stored items are protected from the environment. Optionally, the cover is transparent. Optionally, the armrest has a drink holder.

Optionally, the chair has a large pouch preferably composed of a mesh material so that sand and water are not trapped within. Optionally, there is a set of small pouches for holding smaller items. Optionally, the chair includes a carrying strap.

Other objects of the present invention will become apparent in light of the following drawings and detailed description of the invention.

BRIEF DESCRIPTION OF THE DRAWINGS

For a fuller understanding of the nature and object of the present invention, reference is made to the accompanying drawings, wherein.

DETAILED DESCRIPTION OF THE INVENTION

Figure 1:
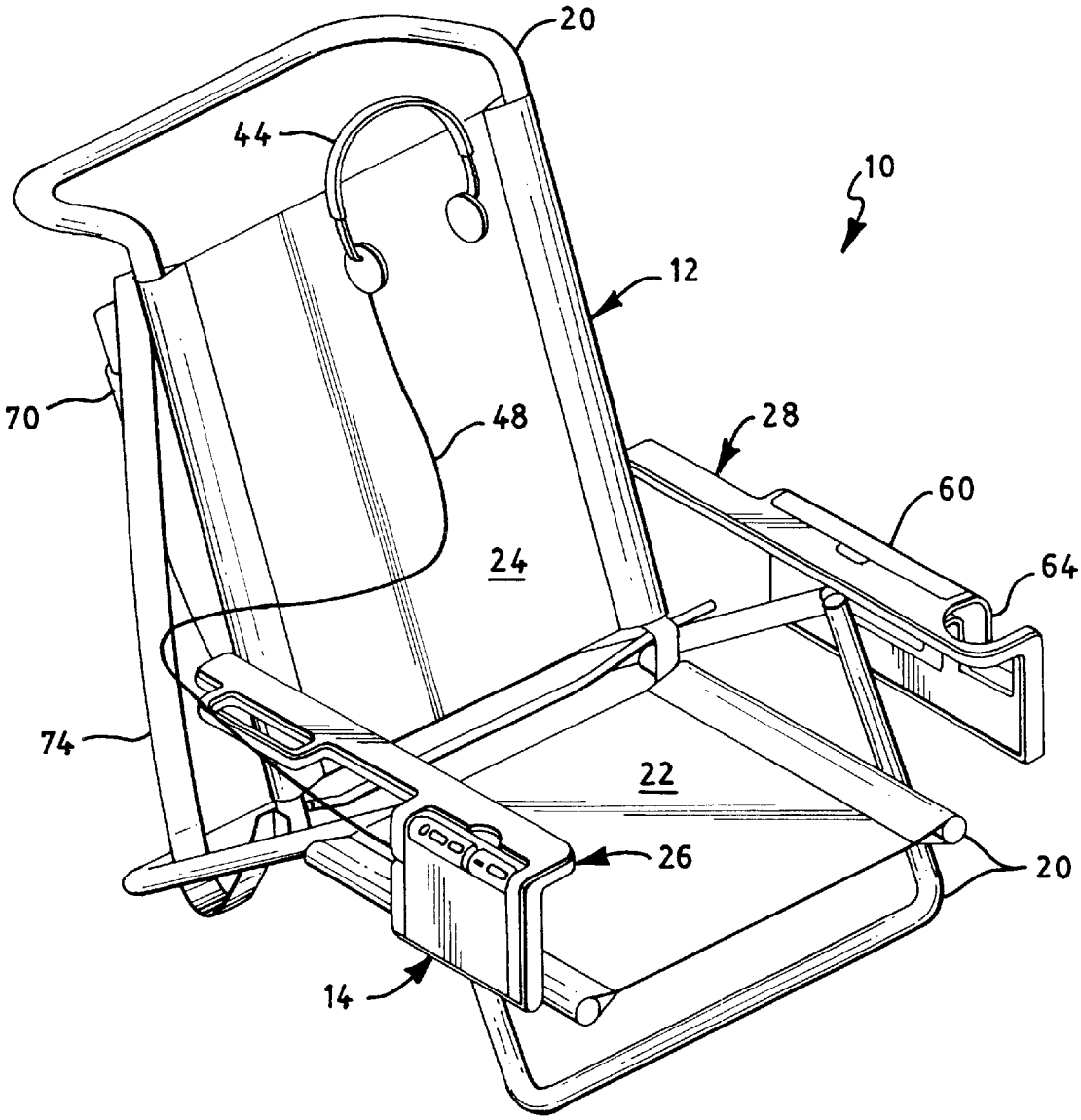
FIG. 1 perspective drawing of the chair/audio player combination of the present invention showing a CD player.

The present invention 10 is a beach chair 12 with an integral audio player 14, as shown in FIG. 1. The player 14 is permanently mounted within the arm rest 26 of the chair 12.

Any general form of beach chair 12 known in the art is contemplated for use by the present invention. The frame 20 is composed of a rigid material, such as aluminum or plastic. The frame 20 is such that the chair 12 can be folded to a more compact size for carrying. There are many ways known in the art for making a chair foldable, and all are contemplated for use with the present invention. The chair 12 has a seat 22 and a back 24 that are formed by any number of means. One such means employs sheets or woven strips of canvas, plastic, or other flexible material, that are attached to the frame 20. Another means includes solid sheets of plastic or other rigid material that is formed as part of the frame 20. The preferred beach chair 12 is light in weight for ease in carrying.

The chair 12 includes a pair of armrests 26, 28. At least one of the armrests 26 includes a permanently-mounted audio player 14. Two configurations of the chair/player 10 may be produced, the configurations differing by which armrest 26, 28 the audio player 14 in mounted in.

Audio players come in many varieties, depending on the medium from which the audio signal is generated. Media include radio waves, tape cassettes, compact discs, MP3s, and minidiscs. Each has its own unique capabilities and controls, and all are contemplated for use by the present invention.

Radio controls include, at a minimum, power, volume, and tune. Other optional controls include tone controls, stereo balance, station search, and station seek. In modern radios, preferred by the present invention, these controls are fully electronic. The advantage to an all electronic radio is that, with no moving parts, the environment has a much smaller detrimental effect.

The other device with no moving parts is the MP3 player. MP3 is a music format in which the music is stored as a compressed software file, in a known format. The MP3 player expands the file as it is being read before sending it to the amplifier and headphone. The MP3 player typically receives music files in one of two ways. If the player has built-in electronic memory, the user downloads music files directly to the memory. In the second, most MP3 players accept memory cards that plug into a socket in the player. The music files are downloaded to the memory card, which is then plugged into the socket in the MP3 player. The later method is more advantageous in that the MP3 player does not have to be in close proximity to a music file repository, such as a personal computer. The MP3 player controls include, at a minimum, power, volume, stop, and play, and typically include features such as file skip and random play. Other optional controls include tone controls and stereo balance.

The other three players, the cassette, CD, and minidisc, all have moving parts because of the nature of the media. They must all accept the media through a door, hatch, or other entry into the player. Depending on the physical location and layout of the player relative to the chair, as discussed below, the media entry may be on the top or side of the player. The cassette player controls include, at a minimum, power, volume, stop, and play, and typically include features such as fast forward, rewind, eject, and track change (for bi-directional players). The CD and minidisc player controls include, at a minimum, power, volume, stop, and play, and typically include features such as file skip and random play. Other optional controls for all players include tone controls and stereo balance.

The present invention also contemplates that players may include the ability to play from more than one medium. For example, the cassette, CD, or minidisc player may include a radio and/or MP3. All combinations of two or more media may be combined into one player.

Figure 2:
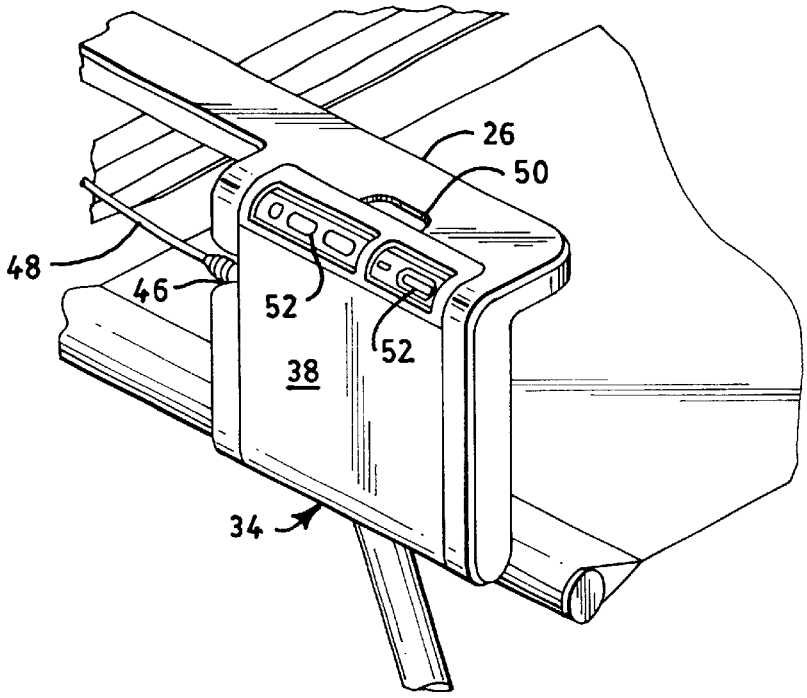
FIG. 2 is a detail of the CD player of FIG. 1 in the closed position.
Figure 3:
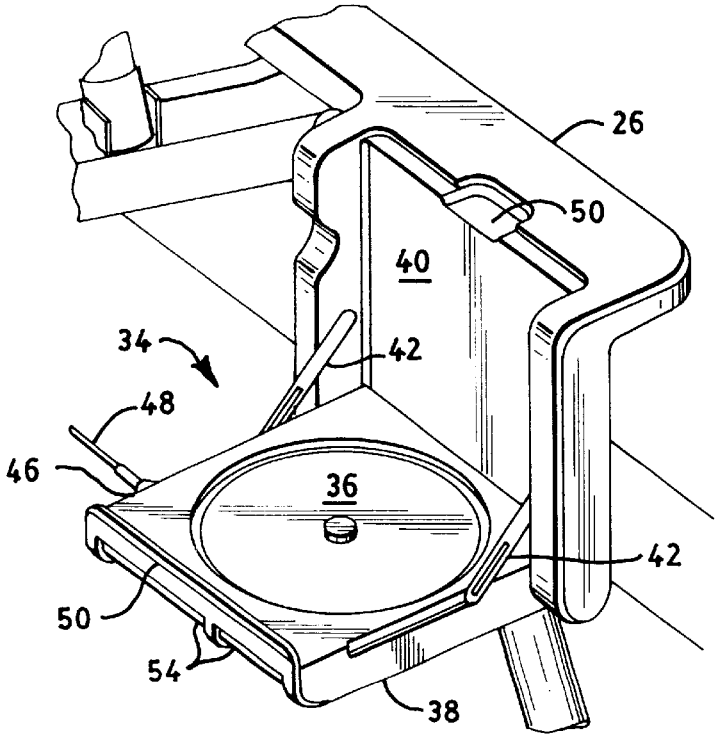
FIG. 3 is a detail of the CD player of FIG. 1 in the open position.

In one configuration of the present invention, shown in FIGS. 2 and 3, the audio player 14 is a CD player 34. The CD player 34 is vertical, that is, it holds the CD vertically within its body. The CD player 34 is hinged at the bottom so that the CD 36 is removable. The hinged section 38 opens outwardly from the stationary section 40 for replacing the CD. Optionally, sliding arms 42 prevent the hinged section 38 from opening more than about 90°. When the hinged section 38 is closed, a seal is formed that substantially prevents the gross detrimental effects of the environment, such as sand and salt water, from harming the CD 36 and CD player 34. The seal may be formed in any manner known in the art, for example, by a rubber o-ring around the perimeter of the hinged section 38 and/or stationary section 40.

The mechanics of the CD player 34 are in either the hinged section 38 or the stationary section 40. The mechanics refer to the motorized portion of the CD player 34 to which the CD is attached and which spins the CD during playing. The electronics of the CD player 34 can be located wherever is practical, either in the hinged section 38, the stationary section, other parts of the chair 12, or distributed amongst these areas. The location of the battery compartment may be where convenient and will be dictated by the physical size of the battery or batteries. The headset 44 is connected to the CD player 34 via a headset jack 46. The headset jack 46 may be located wherever it is convenient, preferably somewhere easy to reach and where the user will not get entangled with the headset wire 48 as he or she moves around normally.

A clasp 50 that extends across the seam between the stationary section 40 and the hinged section 38 holds the CD player 34 closed when the CD is playing. The clasp 50 mechanically snaps to the section to which it is not hinged. The clasp 50 provides an attachment that is robust enough to prevent the two sections from separating under stresses encountered in normal use. The clasp 50 also holds the two sections close enough together to form that seal described above.

In one configuration, the clasp 50 is solid and the CD controls 52 are located on the clasp 50 so that the controls 52 are visible and convenient when the CD player 34 is in use. Alternatively, the CD controls are located in the upper end of the CD player, either on the hinged section 38 or the stationary section 40, and the clasp 50 has openings 54 through which that controls can be viewed and reached, as in FIG. 2. Alternatively, the controls 52 are located on the armrest 26.

In another configuration of the present invention, the audio player 14 is a cassette tape player. Like the CD player 34, the cassette player is vertical, holding the cassette vertically within its body. The cassette player may be hinged at the bottom, also like the CD player 34, or it may have an external slot into which the cassette tape is inserted. In the latter configuration, the cassette tape is protected from the environment when inserted into the cassette player. The slot should have a door to prevent damage to the internal mechanism by the environment when there is no tape in the player.

In another configuration, the audio player 14 is a minidisc player. Since a minidisc is similar to a cassette, the present invention contemplates that the mini disc player may the same configurations as the cassette player.

In another configuration, the audio player 14 is a radio. Since the radio does not require access by removable media, there is no hinged section or external slot. The radio controls are located on the armrest 26. The radio antenna can be built into the chair frame.

In another configuration, the audio player 14 is an MP3 player. Like the radio, some MP3 players do not require access by removable media, so there is no hinged section or external slot. Other MP3 players use an external memory card that is inserted into an external slot. The slot can be sized so that when the memory card is in place, the internal portion of the MP3 player is sealed from the environment. When the memory card in removed, the slot should have a door to prevent damage to the internal mechanism by the environment. As with the radio, the controls are located on the armrest 26.

Finally, as indicated above, the present invention contemplates that the audio player 14 may include players for several media.

Figure 4:
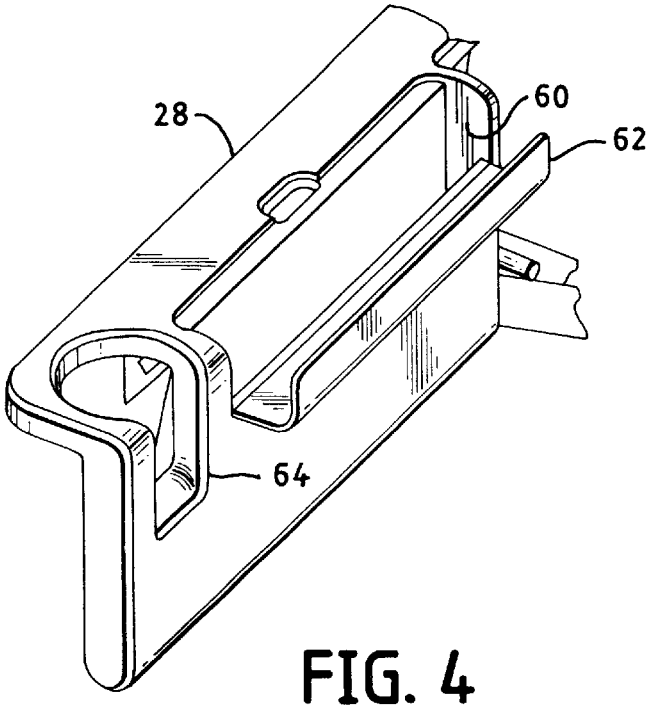
FIG. 4 is a detail of a configuration of the storage compartment.

The armrest 28 without the audio player 14 has a storage compartment 60 for holding items, as shown in FIG. 4. It is preferred that the compartment 60 is large enough to hold at least several copies of the player media. For tape cassettes and minidiscs, the compartment 60 may hold them upright so that the title on the edge of the media can be seen. The present invention also contemplates that the compartment walls may have guide rails forming slots for the media. The rails may be vertical or diagonal. It is also contemplated that the compartment 60 may have a cover 62 so that the items in the compartment 60 are protected from the environment. Optionally, the cover 62 is transparent so that the items are visible without opening the cover 62. The cover 62 may be hinged, as in FIG. 4, or it may be fitted into a horizontal slot so that it slides into the slot out of the way. It may also be mounted by a combination of the two, for example, so that it hinges up and then slides into a vertical slot in the armrest 28.

Optionally, the armrest 28 has a drink holder 64 large enough to hold drink cans. It is further contemplated that the drink holder 64 may be lined with an insulating material to aid in keeping the drink cold.

Figure 5:
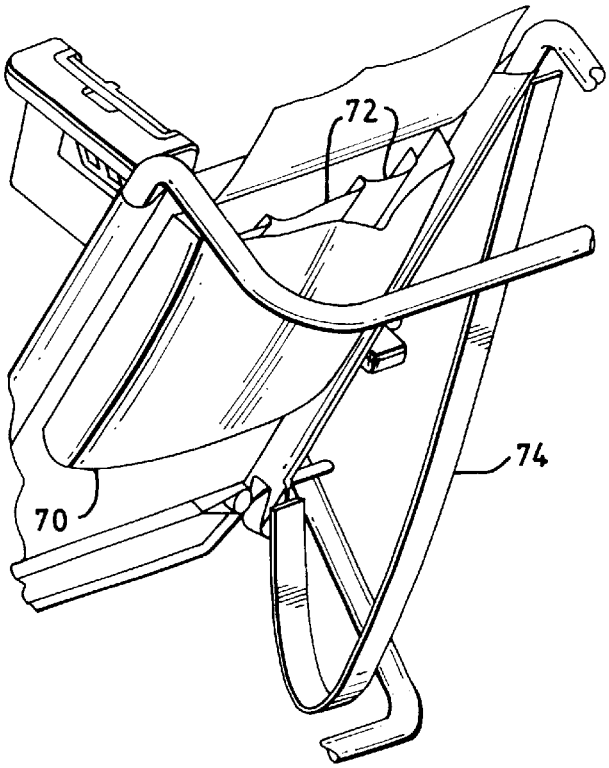
FIG. 5 is a detail of the pouch of FIG. 1.

Optionally, the chair 12 has a pouch 70 for holding larger items such as towels, as shown in FIG. 5. Preferably, the pouch 70 is composed of a mesh material so that sand and water are not trapped within. Optionally, the chair 12 has a set of small pouches 72 for holding smaller items such as magazines, books, etc.

Optionally, the chair 12 includes a carrying strap 74. The strap 74 is wide enough to comfortably hang over the user's shoulder.

Thus it has been shown and described a beach chair with integral audio player which satisfies the objects set forth above.

Since certain changes may be made in the present disclosure without departing from the scope of the present invention, it is intended that all matter described in the foregoing specification and shown in the accompanying drawings be interpreted as illustrative and not in a limiting sense.

I claim:

1. A chair comprising:

(a) a back, a seat, a first armrest, and a second armrest, said chair being foldable;

(b) an audio player integrated into said first armrest, said audio player adapted to play audio media;

(c) a headphone jack and controls for said audio player on said first armrest;

(d) a storage compartment integrated into said second armrest;

(e) a carrying strap; and (f) said audio player substantially protecting said audio media from an outdoor environment when said audio player is playing said audio media.

2. The chair of claim 1 wherein said audio player is a compact disc player, said compact disc player comprising a stationary portion integral with said first armrest, a hinged portion hingedly attached to said stationary portion, and a clasp, said compact disc player having an open position adapted to allow a compact disc to be inserted into and removed from said compact disc player, said compact disc player having a closed position adapted to secure said compact disc in said compact disc player for playing and for substantially protecting said compact disc from said environment, said compact disc player held in said closed position by said clasp.

3. The chair of claim 1 wherein said audio player is a tape cassette player, said tape cassette player having a slot adapted to receive a tape cassette, said tape cassette being substantially protected from said environment when received in said tape cassette player.

4. The chair of claim 1 wherein said storage compartment has a cover.

5. The chair of claim 1 wherein said second armrest includes a drink holder.

6. The chair of claim 1 wherein said chair back includes at least one pouch, said pouch being porous to sand and water.

* * * * *